US007699071B2

(12) United States Patent
Burkhard et al.

(10) Patent No.: US 7,699,071 B2
(45) Date of Patent: Apr. 20, 2010

(54) LINEAR MOTOR TO PRE-BIAS SHUTTLE FORCE

(75) Inventors: Alan Wayne Burkhard, Fort Thomas, KY (US); Nicolas Christopher Wade Thiessen, Edmonton (CA)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 11/959,970

(22) Filed: Dec. 19, 2007

(65) Prior Publication Data

US 2008/0149391 A1 Jun. 26, 2008

Related U.S. Application Data

(60) Provisional application No. 60/871,211, filed on Dec. 21, 2006.

(51) Int. Cl.
*F16K 31/12* (2006.01)

(52) U.S. Cl. ..... 137/509; 175/38; 175/218; 137/495

(58) Field of Classification Search ..... 137/509; 251/48, 52, 63, 63.5, 63.6, 121; 175/38, 175/48, 218
See application file for complete search history.

(56) References Cited

U.S. PATENT DOCUMENTS 3,372,761 A * 3/1968 Van Gils ..... 175/25
4,103,864 A * 8/1978 Hagendorn ..... 251/63.6
4,355,784 A 10/1982 Cain
5,586,482 A * 12/1996 Leonard ..... 91/519
6,253,787 B1 7/2001 Suter et al.
6,575,244 B2 6/2003 Chang et al.
6,640,688 B1 * 11/2003 Harper ..... 92/23
6,755,261 B2 * 6/2004 Koederitz ..... 175/25
6,920,942 B2 * 7/2005 Koederitz ..... 175/25
7,004,448 B2 2/2006 Suter et al.
2005/0006150 A1 1/2005 Sims et al.
2006/0097212 A1 * 5/2006 Kindersley ..... 251/229
2008/0149182 A1 * 6/2008 Burkhard et al. ..... 137/12
2008/0149200 A1 * 6/2008 Burkhard et al. ..... 137/565.11

OTHER PUBLICATIONS

PCT International Search Report issued in PCT Application No. PCT/US2007/088437 dated Apr. 22, 2008 (3 pages).
PCT Written Opinion issued in PCT Application No. PCT/US2007/088437 dated Apr. 22, 2008 (4 pages).

* cited by examiner

*Primary Examiner*—David J Bagnell
*Assistant Examiner*—Blake Michener
(74) *Attorney, Agent, or Firm*—Osha Liang LLP

(57) ABSTRACT

A method of controlling one or more operating pressures within a subterranean borehole that includes a choke assembly is disclosed. The choke assembly may include a housing having an inlet passage, an axial bore, and a chamber, wherein a portion of the axial bore forms an outlet passage, and a choke member adapted for movement in the housing to control the flow of a fluid from the inlet passage to the outlet passage. The method may include applying a closing force to move the choke member toward a closed position, and applying a bias force to the choke member when in the closed position to reduce an overpressure required to initiate movement of the choke member from the closed position.

15 Claims, 6 Drawing Sheets

LINEAR MOTOR TO PRE-BIAS SHUTTLE FORCE

CROSS-REFERENCE TO RELATED APPLICATION

This application claims benefit to U.S. Provisional Application Ser. No. 60/871,211, filed Dec. 21, 2006, the disclosure of which is hereby incorporated by reference.

BACKGROUND OF INVENTION

1. Field of the Invention

Embodiments disclosed herein relate generally to subterranean boreholes, and in particular, to systems for controlling the operating pressures within subterranean boreholes.

2. Background

There are many applications in which there is a need to control the back pressure of a fluid flowing in a system. For example, in the drilling of oil wells it is customary to suspend a drill pipe in the wellbore with a bit on the lower end thereof and, as the bit is rotated, to circulate a drilling fluid, such as a drilling mud, down through the interior of the drill string, out through the bit, and up the annulus of the wellbore to the surface. This fluid circulation is maintained for the purpose of removing cuttings from the wellbore, for cooling the bit, and for maintaining hydrostatic pressure in the wellbore to control formation gases and prevent blowouts, and the like. In those cases where the weight of the drilling mud is not sufficient to contain the bottom hole pressure in the well, it becomes necessary to apply additional back pressure on the drilling mud at the surface to compensate for the lack of hydrostatic head and thereby keep the well under control. Thus, in some instances, a back pressure control device is mounted in the return flow line for the drilling fluid.

Back pressure control devices are also necessary for controlling "kicks" in the system caused by the intrusion of salt water or formation gases into the drilling fluid which may lead to a blowout condition. In these situations, sufficient additional back pressure must be imposed on the drilling fluid such that the formation fluid is contained and the well controlled until heavier fluid or mud can be circulated down the drill string and up the annulus to kill the well. It is also desirable to avoid the creation of excessive back pressures which could cause the drill string to stick or cause damage to the formation, the well casing, or the well head equipment.

Referring to FIG. 1, a typical oil or gas well 10 may include a wellbore 12 that has a wellbore casing 16. During operation of the well 10, a drill pipe 18 may be positioned within the wellbore 12. As will be recognized by persons having ordinary skill in the art, the end of the drill pipe 18 may include a drill bit and drilling mud may be injected through drill pipe 18 to cool the drill bit and remove particles drilled by the drill bit. A mud tank 20 containing a supply of drilling mud may be operably coupled to a mud pump 22 for injecting the drilling mud into the drill pipe 18. The annulus 24 between the wellbore casing 16 and the drill pipe 18 may be sealed in a conventional manner using, for example, a rotary seal 26.

In order to control the operating pressures within the well 10 within acceptable ranges, a choke 28 may be operably coupled to the annulus 24 in order to controllably bleed pressurized fluidic materials out of the annulus 24 back into the mud tank 20 to thereby create back pressure within the wellbore 12.

The choke 28, in some well systems, may be manually controlled by a human operator 30 to maintain one or more of the following operating pressures within the well 10 within acceptable ranges: (1) the operating pressure within the annulus 24 between the wellbore casing 16 and the drill pipe 18, commonly referred to as the casing pressure (CSP); (2) the operating pressure within the drill pipe 18, commonly referred to as the drill pipe pressure (DPP); and (3) the operating pressure within the bottom of the wellbore 12, commonly referred to as the bottom hole pressure (BHP). In order to facilitate the manual human control 30 of the CSP, the DPP, and the BHP, sensors, 32*a*, 32*b*, and 32*c*, respectively, may be positioned within the well 10 that provide signals representative of the actual values for CSP, DPP, and/or BHP for display on a conventional display panel 34. Typically, the sensors, 32*a* and 32*b*, for sensing the CSP and DPP, respectively, are positioned within the annulus 24 and drill pipe 18, respectively, adjacent to a surface location. The operator 30 may visually observe one or more of the operating pressures, CSP, DPP, and/or BHP, using the display panel 34 and may manually maintain the operating pressures within predetermined acceptable limits by manually adjusting the choke 28. If the CSP, DPP, and/or the BHP are not maintained within acceptable ranges, an underground blowout can occur, thereby potentially damaging the production zones within the subterranean formation 14. The manual operator control 30 of the CSP, DPP, and/or the BHP may be imprecise, unreliable, and unpredictable. As a result, underground blowouts occur, thereby diminishing the commercial value of many oil and gas wells.

Alternatives to manual control may include balanced fluid control and automatic choke control. For example, U.S. Pat. No. 4,355,784 discloses an apparatus and method for controlling back pressure of drilling fluid. A balanced choke device moves in a housing to control the flow and back pressure of the drilling fluid. One end of the choke device is exposed to the pressure of the drilling fluid and its other end is exposed to the pressure of a control fluid.

U.S. Pat. No. 6,253,787 discloses a system and method where the movement of the choke member from a fully closed position to an open position is dampened. An inlet passage and an outlet passage are formed in a housing, and a choke member is movable in the housing to control the flow of fluid from the inlet passage to the outlet passage and to exert a back pressure on the fluid, thus dampening the movement of the choke member. The choke device may operate automatically to maintain a predetermined back pressure on the flowing fluid despite changes in fluid conditions.

U.S. Pat. No. 6,575,244 discloses a system and method to monitor and control the operating pressure within tubular members (drill pipe, casing, etc.). The difference between actual and desired operating pressure is used to control the operation of an automatic choke to controllably bleed pressurized fluidic materials out of the annulus.

During low pressure operations and pump startup, for example, choke systems may encounter mechanical "sticktion." Sticktion as used herein refers to the temporary adhesion that prevents movement of choke system components, or the slothful reaction in the movement of the choke system components due to the need for an overpressure to initiate movement. This delay may negatively affect borehole operations.

Accordingly, there exists a need for a system capable of tighter control of system pressure (CSP, BHP, and/or DPP) in maintaining the user set point pressure (the desired pressure to be maintained in the casing, drillpipe, or borehole). There also exists a need to improve the operation of choke systems during low pressure operations.

SUMMARY OF INVENTION

In one aspect, embodiments disclosed herein relate to a method of controlling one or more operating pressures within a subterranean borehole that includes a choke assembly comprising a housing having an inlet passage, an axial bore, and a chamber, wherein a portion of the axial bore forms an outlet passage, and a choke member adapted for movement in the housing to control the flow of a fluid from the inlet passage to the outlet passage. The method may include applying a closing force to move the choke member toward a closed position, and applying a bias force to the choke member when in the closed position to reduce an overpressure required to initiate movement of the choke member from the closed position.

In another aspect, embodiments disclosed herein relate to a fluid control system. The fluid control system may include a choke assembly and a controller. The choke assembly may have a housing having an inlet passage, an axial bore, and a chamber, wherein a portion of the axial bore forms an outlet passage, and a choke member adapted for movement in the housing to control the flow of a fluid from the inlet passage to the outlet passage. The controller may control a closing force applied to the choke member, thereby forcing the choke member toward a closed position and to control a bias force applied to the choke member, thereby reducing an overpressure required to initiate movement of the choke member from the closed position.

Other aspects and advantages of the invention will be apparent from the following description and the appended claims.

DETAILED DESCRIPTION

In one aspect, embodiments disclosed herein relate to the use of electrical energy to generate the hydraulic force necessary to operate a choke system. In some embodiments, the electrical energy may be directly correlated to hydraulic energy without positional constraints. In other embodiments, a control system may use proportional, integral, and/or derivative (PID) functions to control the hydraulic set point in order to achieve control of the casing pressure in maintaining pressure near the user set point. In yet other embodiments, the control system may be used to bias a shuttle toward an open position, thus decreasing the required overpressure to initiate shuttle movement.

Figure 1:
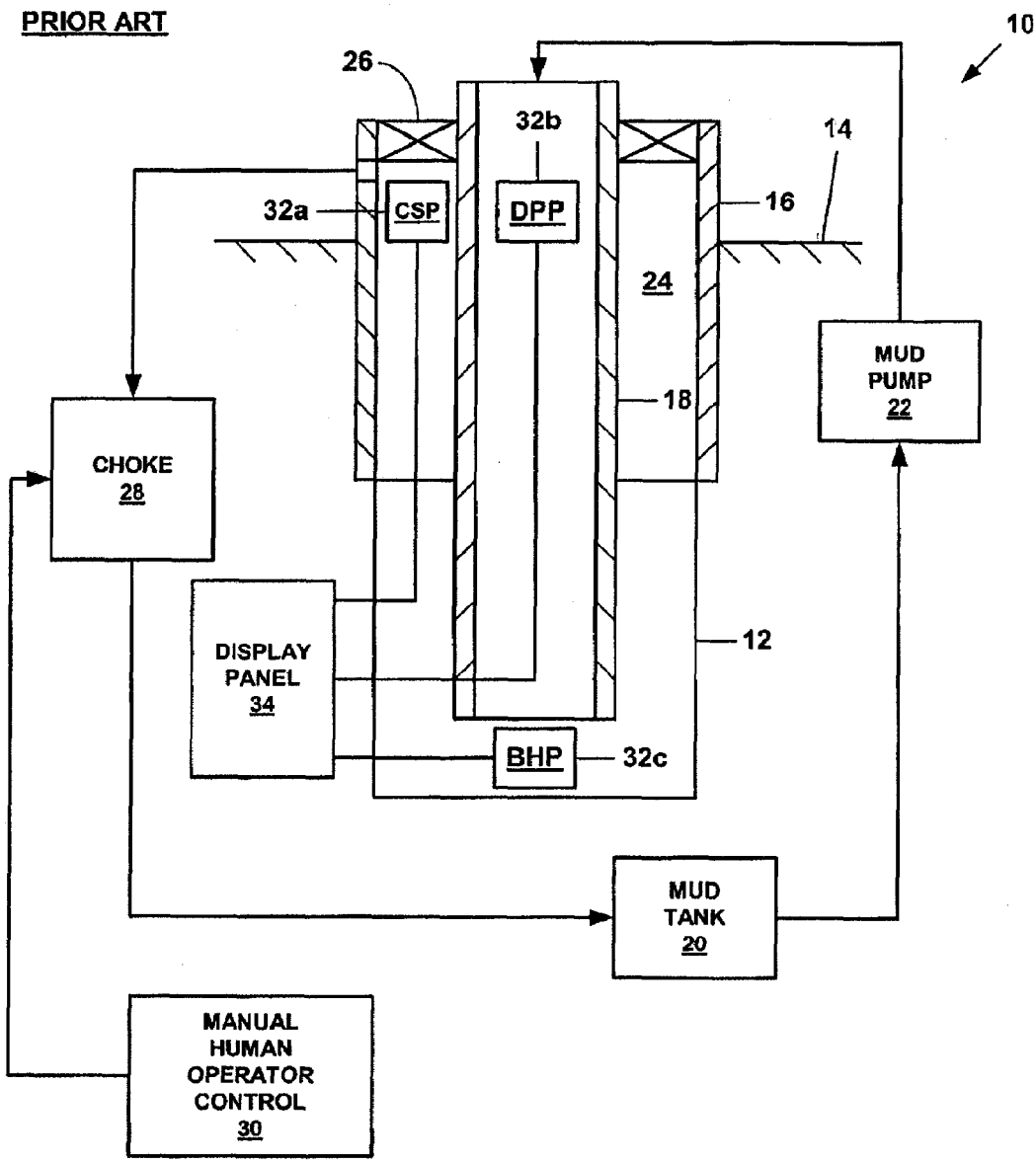
FIG. 1 is a schematic illustration of an embodiment of a conventional oil or gas well.
Figure 2:
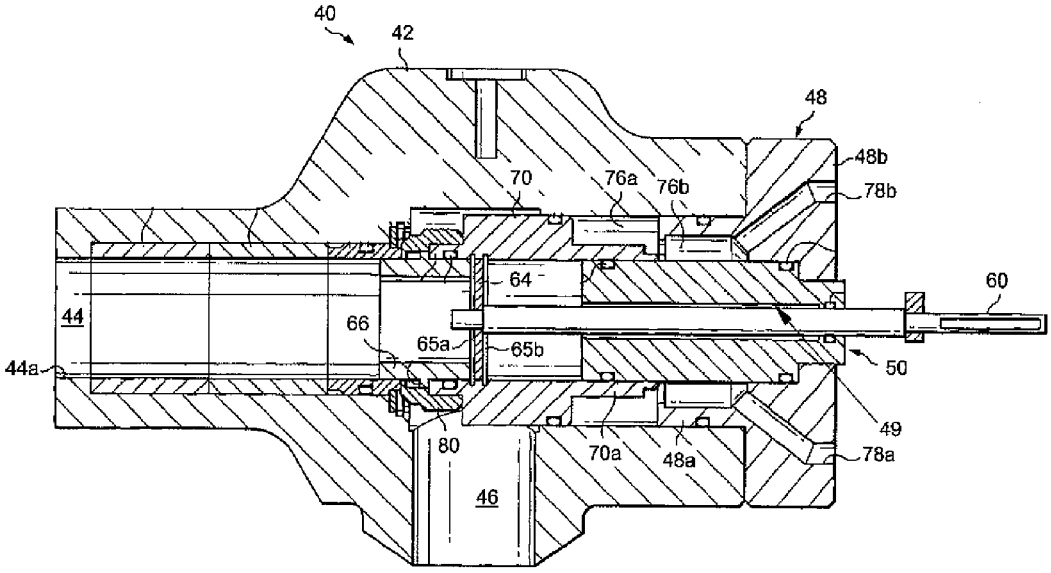
FIG. 2 is a cross sectional view of a choke valve useful in embodiments disclosed herein.

A choke system useful in embodiments disclosed herein is illustrated in FIG. 2. Choke system 40 includes a housing 42 having an axial bore 44 extending through its length and having a discharge end 44*a*. A radially extending inlet passage 46 is also formed in the housing 42 and intersects the bore 44. It is understood that connecting flanges, or the like, (not shown) may be provided at the discharge end 44*a* of the bore 44 and at the inlet end of the passage 46 to connect them to appropriate flow lines. Drilling fluid from a downhole well is introduced into the inlet passage 46, passes through the housing 42 and normally discharges from the discharge end 44*a* of the bore 44 for recirculation.

As shown, a bonnet 48 is secured to the end of the housing 42 opposite the discharge end 44*a* of the bore 44. The bonnet 48 is substantially T-shaped in cross section and has a cylindrical portion 48*a* extending into the bore 44 of the housing. The bonnet 48 also includes a cross portion 48*b* that extends perpendicular to the cylindrical portion 48*a* and is fastened to the corresponding end of the housing 42 by any conventional manner, for example, bonnet 48 may be threadedly or weldably connected to housing 42.

A mandrel 50 is secured in the end portion of the bonnet 48, and a rod 60 is slidably mounted in an axial bore 49 extending through the mandrel 50. A first end portion of the rod 60 extends from a first end of the mandrel 50 and the bonnet 48, and a second end portion of the rod 60 extends from a second end of the mandrel 50 and into the bore 44.

A spacer 64 is mounted on the second end of the rod 60 in any known manner and may be disposed between two snap rings 65*a* and 65*b*. A cylindrical choke member 66 is disposed in the bore 44 with one end abutting the spacer 64. The choke member 66 is shown in its fully closed position in FIG. 2, wherein choke member 66 extends in the intersection of the bore 44 with the inlet passage 46 to control the flow of fluid from inlet passage 46 to bore 44.

A cylindrical shuttle 70 is slidably mounted over the mandrel 50. The shuttle 70 has a reduced-diameter portion 70*a* that defines, with the inner surface of the housing 42, a fluid chamber 76*a*. Another fluid chamber 76*b* is defined between the outer surface of the mandrel 50 and the corresponding inner surface of the bonnet portion 48*a*. The chambers 76*a* and 76*b* communicate and receive a control fluid from a passage 78*a* formed through the bonnet 48. Passage 78*a* is connected to a hydraulic system as described below for circulating the control fluid into and from the passage. A passage 78*b* may also be formed through the bonnet portion 48 for bleeding air from the system through a bleed valve, or the like (not shown), before operation. In this context, the control fluid is introduced into the passage 78*a*, and therefore, the chambers 76*a* and 76*b*, at a predetermined set point pressure.

The control fluid enters the chambers 76*a* and 76*b* and applies pressure against the corresponding exposed end portions of the shuttle 70. The shuttle 70 is designed to move so the force caused by the pressure of the control fluid from the chambers 76*a* and 76*b* at the predetermined set point pressure acting on the corresponding exposed end portions of the shuttle is equal to the force caused by the pressure of the drilling fluid in the passage 46 acting on the corresponding exposed end portions of the other end of the shuttle 70 and a retainer 80. Axial movement of the shuttle 70 over the fixed mandrel 50 causes corresponding axial movement of the choke member 66, and therefore the spacer 64 and the rod 60.

Other embodiments of choke valves that may be useful in embodiments disclosed herein may include actuated rod systems. For example, an air or hydraulic actuator may controllably move the rod, varying shuttle position to control system pressure. Other embodiments of choke valves that may be useful in embodiments disclosed herein may include those described in U.S. Pat. Nos. 4,355,784, 6,253,787 and 7,004,448, assigned to the assignee of the present invention and incorporated by reference herein.

The position of the shuttle within the choke system may be controlled in some embodiments by one or more linear motors directly or indirectly coupled to the rod. In other embodiments, a linear motor directly or indirectly coupled to the rod may directly provide a force to the shuttle. In other embodiments, a hydraulic force supplied to a control fluid used to control the shuttle position may be supplied by one or more linear motors. These and other embodiments for use of linear motors with a choke system are described in more detail below.

Linear motors use electromagnetism to controllably vary the position or force of a movable component with respect to a stationary component. In some embodiments, the linear motors used in embodiments disclosed herein may include flat linear motors, tubular linear motors, or combinations thereof. Where reference may be made to flat linear motors in some embodiments, tubular linear motors may also be used, and vice versa.

Linear motors may include moving coil, moving magnet, alternating current (AC) switched reluctance design, AC synchronous design, AC induction or traction design, linear stepping design, direct current (DC) brushed design, and DC brushless design, as known in the art. In a moving coil design, for example, the coil moves and the magnet is fixed. In a moving magnet design, for example, the magnet moves and the coil is fixed.

Important specifications to consider include rated continuous thrust force, peak force, maximum speed, maximum acceleration, nominal stator length, slider or carriage travel, slide or carriage width, and slider or carriage length. For example, for use of a linear motor to supply a constant force, the rated continuous thrust force, the maximum rated current that can be supplied to the motor windings without overheating, is an important design variable.

Linear motors allow for relatively fast accelerations and relatively high velocities of the movable component, which may allow for tighter control of the shuttle position or hydraulic pressure set point. In some embodiments, the one or more linear motors may have a velocity between end points of up to 500 in/sec; up to 400 in/sec in other embodiments; up to 300 in/sec in other embodiments; up to 250 in/sec in other embodiments; up to 200 in/sec in other embodiments; and up to 100 in/sec in yet other embodiments. In other embodiments, the velocity between endpoints may be variable and/or controllable. In some embodiments, the linear motor may accelerate a movable component at rates as high as 98 $m/s^2$ (10 G's); up to 8 G's in other embodiments; up to 6 G's in other embodiments; and up to 5 G's in yet other embodiments. Thus, in some embodiments, such as where a linear motor is directly coupled to the rod for example, the linear motor may rapidly open and close the shuttle to maintain pressure in the tubulars around the set point pressure.

Linear motors may advantageously provide a constant and reversible force. For example, for a tubular linear motor having a moving magnet (similar to a piston moving within a cylinder), magnetic-attractive forces may be applied causing the magnet to move with a constant force. Application of a constant force may provide for consistency of operation of the choke, for example, where a linear motor is used to generate a hydraulic force to operate the shuttle. When the pressure (CSP, DPP, and/or BHP as appropriate) exceeds the force applied by the linear motor, the moving magnet may be moved toward an open position so as to allow the pressure in the tubular(s) to be vented while maintaining a force on the shuttle toward a closed position with the linear motor. Thus, when the pressure decreases, the shuttle will automatically move toward the closed position, maintaining pressure control within the tubulars.

Linear motors also allow for a relatively high degree of precision in controlling the position of the movable component relative to the stationary component. In some embodiments, the positioning may be repeatable to within 10 microns of previous cycles; within 5 microns in other embodiments; and within 1 micron in yet other embodiments. Repeatable positioning may provide for consistency of operation of the choke due to reliable positioning, for example, where a linear motor is used to directly operate the shuttle.

In one embodiment, a linear motor may be attached to a hydraulic cylinder used to supply a control fluid to a choke. The linear motor may have sufficient motor force and cylinder ratio to drive the choke. A linear motor, having a movable component and a stationary component, may be directly or indirectly coupled to a hydraulic cylinder. The current (amperage) supplied to the linear motor may be used to generate a constant force on a piston of a hydraulic cylinder supplying the hydraulic pressure to the control fluid in the choke system, such as the control fluid flowing into and out of passage 78*a* (FIG. 2).

Figure 3A:
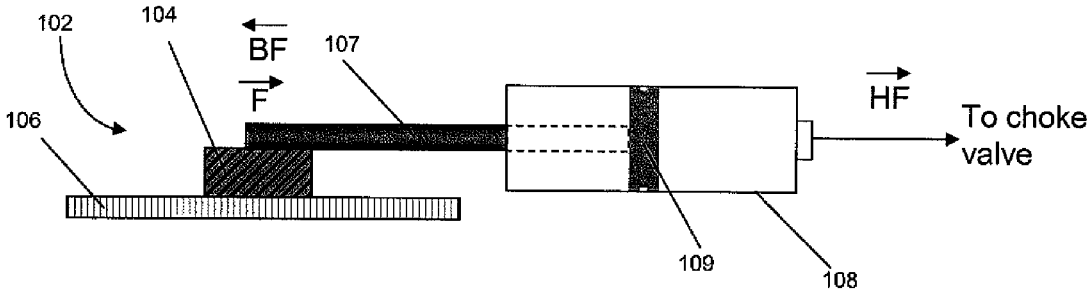
FIGS. 3*a* and 3*b* are schematic illustrations of a linear motor driven hydraulic system in accordance with embodiments disclosed herein, useful for supplying a set point pressure to a control fluid of a choke valve.
Figure 3B:
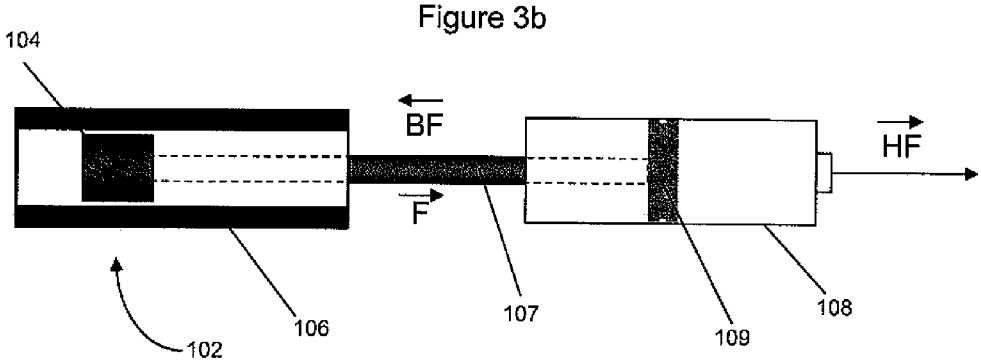

For example, as illustrated in FIGS. 3*a* and 3*b*, a linear motor 102, having a movable component 104 and a stationary component 106, may be coupled to rod 107 of hydraulic cylinder 108. As illustrated in FIG. 3*a*, linear motor 102 may be a flat linear motor; as illustrated in FIG. 3*b*, linear motor 102 may be a tubular linear motor. Linear motor 102 may supply a constant force F to rod 107 and piston 109, which translates to a hydraulic force HF by acting upon a fluid within hydraulic cylinder 108.

Linear motor 102 may use amperage control to directly generate the desired hydraulic force HF supplying the hydraulic pressure to the control fluid. In this manner, the motor controller, coupled to the hydraulic system, may continuously attempt to close the choke shuttle. The controller may vary the current supplied to the linear motor, varying the strength of the magnetic attractive force between the stationary component 106 and the movable component 104, generating the desired hydraulic force HF. In some embodiments, the controller may incorporate PID control to not only set the hydraulic output based on the set point pressure, but may also vary the output to maintain tighter set point control.

One benefit of using a linear motor may be in the automatic response of the choke system. Because the linear motor movable component may be free-floating with respect to the stationary component, and the controller may provide only the force necessary to maintain set point pressure, the position of movable component 104 may fluctuate to intermittently allow fluid to pass through the choke system, maintaining pressure control. For example, referring to FIGS. 2 and 3, as pressure in inlet 46 increases above a set point pressure, shuttle 70 may be moved toward an open position, increasing control fluid pressure, which in turn may move moveable component 104 on track 106. As pressure in inlet 46 decreases below a set point pressure, shuttle 70 may be moved back toward a closed position due to the constant force applied by linear motor 102. A change in pressure would not need to be sensed and then "released," as in a positional type choke, thus resulting in a quicker response time for controlling system pressure.

Additionally, because a linear motor is not positionally bound, as in a screw type motor, the linear motor does not need to correlate position to pressure. The linear motor position may be held only by electrical energy and may be allowed to freely move along the track in either direction as the system forces dictate.

Figure 4:
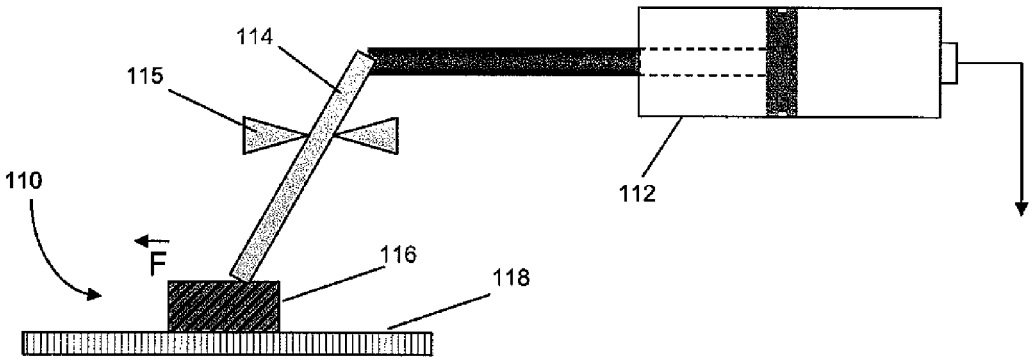
FIG. 4 is a schematic illustration of a linear motor driven hydraulic system in accordance with embodiments disclosed herein.

Referring now to FIG. 4, a linear motor 110 may be indirectly coupled to hydraulic cylinder 112 supplying a control fluid to a choke. Linear motor may be indirectly coupled to the hydraulic cylinder 112 using lever arm 114 across a pivot point 115. Similar to the system described above, linear motor 110, having moving component 116 and stationary component 118, coupled to hydraulic cylinder 112, may deliver a constant hydraulic force HF to the control fluid.

The use of a lever arm 114 may provide a mechanical advantage between the linear motor and the hydraulic cylinder by increasing the force F supplied by the linear motor. In this manner, the amount of hydraulic force available at the cylinder may be increased, the size of the linear motor may be decreased, or the diameter of the hydraulic cylinder may be increased, thereby decreasing the travel distance and allowing for a more compact system.

Figure 5A:
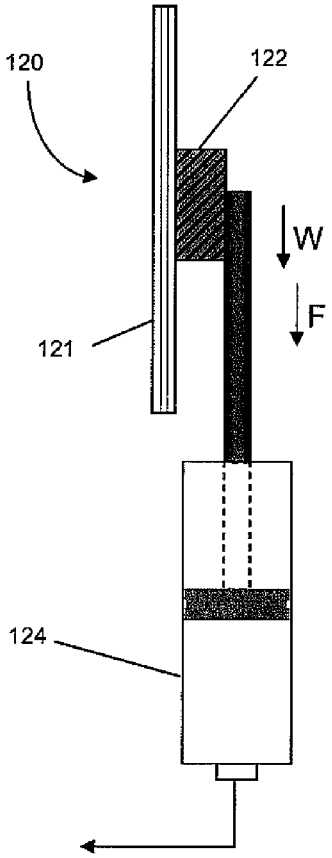
FIGS. 5*a*-5*c* are schematic illustrations of a linear motor driven hydraulic system in accordance with embodiments disclosed herein.

The linear motors of FIGS. 3 and 4 described above are illustrated as being horizontally disposed. Referring now to FIG. 5*a*, a linear motor 120, having a stationary component 121 and a movable component 122, may be mounted vertically, or at some angle relative to horizontal, and coupled directly or indirectly to the hydraulic cylinder 124. The weight of the movable component 122 (the forcer or the track, depending on which is surface mounted) may be used to increase the maximum force F applied to the hydraulic cylinder 124. Gravity adds the weight W of the forcer 122 (or a fraction of the weight when disposed at an angle to horizontal other than vertically) to the continuous force F applied by the movable component, thus supplying a greater amount of hydraulic force HF than with the linear motor in a horizontal position. In this manner, gravity may allow the use of a smaller motor than would be required otherwise.

Figure 5B:
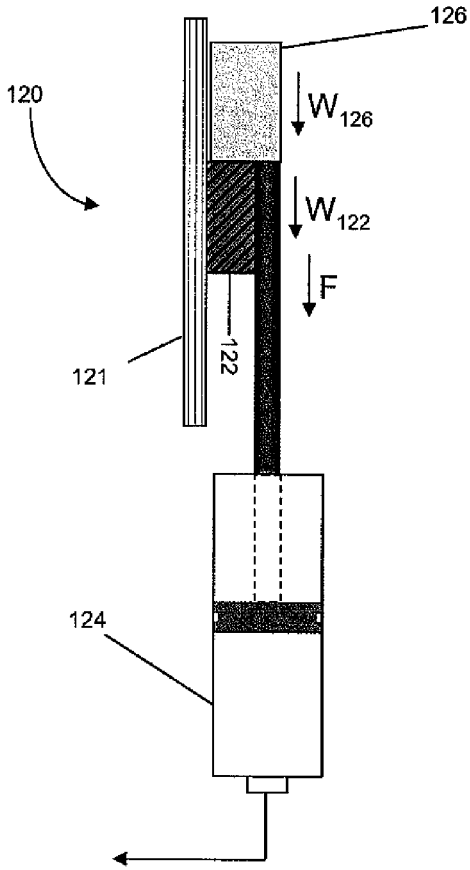

Referring now to FIG. 5*b*, in other embodiments, weights 126 may be added to the movable component 122 to increase the hydraulic force HF available. To reduce the hydraulic pressure below the weight of the movable component 122 and the weights 126, linear motor 120 may supply a magnetic attractive force to force the movable component 122 upward to counteract the combined weight of the movable component 122 and weights 126. In this manner, the size of the linear motor required to generate the desired hydraulic force may be decreased.

Figure 5C:
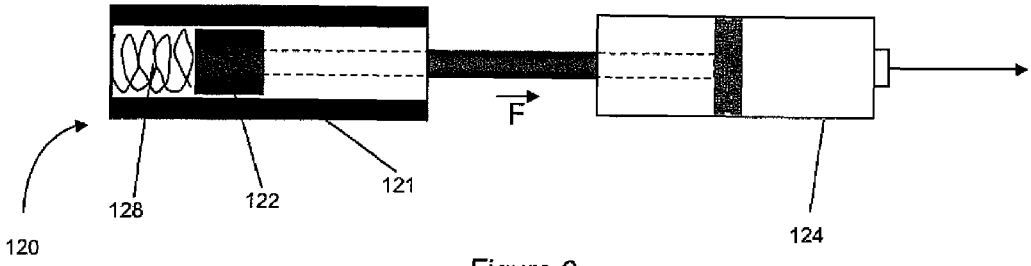

Referring now to FIG. 5*c*, in other embodiments, springs 128 may be used to provide additional force to the movable component 122, increasing the force available. To reduce the hydraulic pressure, the linear motor 120 may supply a magnetic attractive force to move the movable component 122 to counteract the force applied by spring 128. In this manner, the size of the linear motor required to generate the desired hydraulic force HF may be decreased. The use of springs may be used to provide additional force to a horizontally, vertically, or otherwise disposed movable component.

Figure 6:
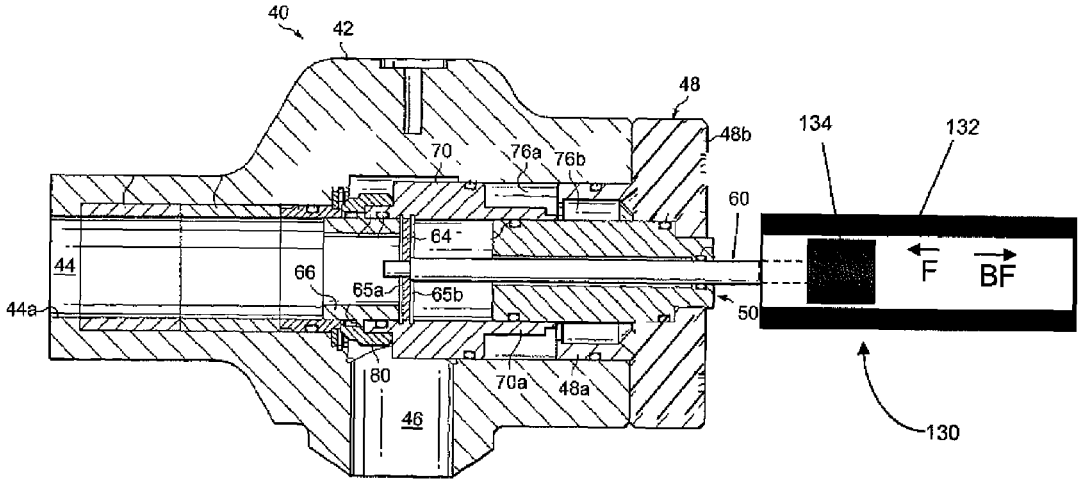
FIG. 6 is a schematic illustration of a linear motor driven choke system in accordance with embodiments disclosed herein.

Referring now to FIG. 6, a linear motor 130, having a stationary component 132 and a movable component 134, may be directly or indirectly coupled to the rod 60 of a choke valve 40 to provide a pressure balancing force. A linear motor, as stated above, may use amperage control to directly generate a desired force. As opposed to controlling the hydraulic pressure of a control fluid, a linear motor coupled directly or indirectly to the rod may be used to control the force applied to the shuttle 70, thereby eliminating the need for the intermediate hydraulic system. In this manner, the servo controller (not shown) may continuously apply a force toward a closed position to choke 66 by applying a force to rod 60. The controller may vary the current supplied to the linear motor 130, varying the strength of the magnetic attractive force between the stationary component 132 and the movable component 134, generating the desired force. In some embodiments, the controller may incorporate PID control to not only set the output based on the set point pressure, but may also vary the output to maintain tighter set point control. Because the linear motor may be operated in a constant force control mode, it may provide instantaneous pressure response, generating a direct correlation between current and pressure.

In other embodiments, a linear motor 130 may be directly or indirectly coupled to the rod 60 of the choke 40 to control the position of shuttle 70. A linear motor, similar to an air or hydraulic actuator, may control the position of the shuttle 70 in response to tubular pressures.

As described above, linear motors may provide a controlled hydraulic force supplied to the control fluid. However, sticktion may slow the response time of the hydraulic system to changes in casing pressure, such as in lower pressure applications for example. Once closed, a pressure greater than the set point pressure may be required to move the shuttle. In some instances, for example, an overpressure of up to 500 psi may be required to overcome the sticktion.

Referring back to FIG. 3*a*, in one example, when the shuttle is in the fully closed position, a suction or bias force BF may be applied to the hydraulic system using linear motor 102. For example, for a choke valve operating at a low pressure set point requiring a 300 psi overpressure to initiate shuttle motion, linear motor 102 may apply a bias force BF of 200 psi, simulating pressure on the inlet. Thus, as opposed to a 300 psi overpressure to move the shuttle, the overpressure may be reduced to 100 psi. In this manner, the linear motor may allow for tighter pressure control and may maintain a smoother bore hole pressure (decreasing the magnitude of the high pressure peaks, for example).

Figure 7:
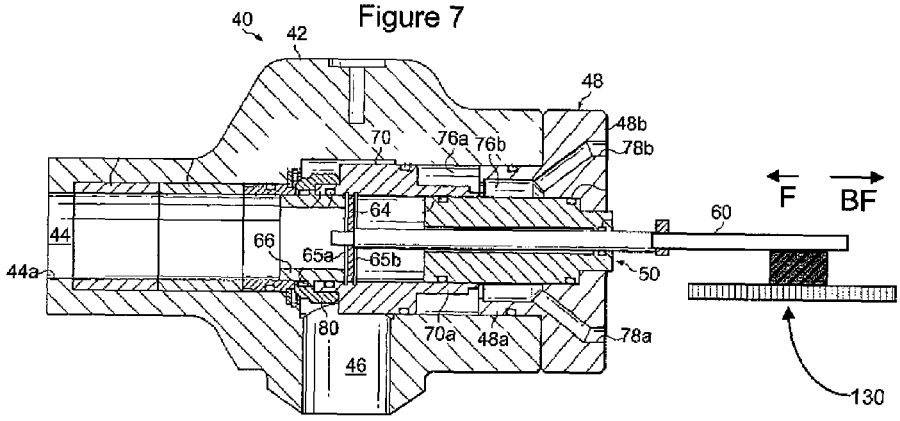
FIG. 7 is a schematic illustration of a hydraulic driven choke system having a linear motor to bias the shuttle in accordance with embodiments disclosed herein.

Similarly, referring now to FIG. 7, in another example, when the shuttle is in the fully closed position, a suction or bias force BF may be applied to the rod 60 using linear motor 130 operating in constant force mode, operating independent of a hydraulic fluid system for controlling choke position. For example, for a choke valve operating at a low pressure set point requiring a 300 psi overpressure to initiate shuttle motion, linear motor 130 may apply a bias force BF of 200 psi, simulating pressure on the inlet. Thus, as opposed to a 300 psi overpressure to move the shuttle, the overpressure may be reduced to 100 psi. In this manner, the linear motor 130 may allow for tighter pressure control and may maintain a smoother bore hole pressure (decreasing the magnitude of the high pressure peaks, for example).

Systems using a linear motor to apply the hydraulic force HF and the bias force BF, in accordance with embodiments disclosed herein, to move the shuttle may also include a controller to control the magnitude of forces HF, F, and BF based upon the pressure in the tubulars and the position of the shuttle (open or closed). The hydraulic pressure control system may include logic based upon set point pressure, casing pressure, and choke valve properties to determine when a bias force BF would be advantageous, what bias force to apply, and to shut off the bias force when it is desired to close the shuttle, applying only force F.

For example, when tubular pressure is greater than a set point pressure plus required bias pressure, a PD controller may decrease the force F generated by the linear motor and increase the bias force BF. As borehole (tubular) pressure returns toward set point, the bias force BF may be decreased, increasing the hydraulic force HF applied by the linear motor. In this manner, control of the hydraulic forces HF applied by the linear motor may allow for a faster system response in opening and closing the shuttle. Thus, the magnitude of the high pressure peaks and low pressure valleys may be decreased, illustrative of smoother, more consistent pressure control. Linear motors may advantageously meet the need for fast acceleration when reversible forces F, BF are applied to control system pressure in this manner.

The use of a bias force on the shuttle may also be applied to conventional air and/or hydraulic systems used to control shuttle position. In these systems, a single-acting or double-acting actuator may be used to move the rod and shuttle to effectuate system pressure control. As described above, once closed, a pressure greater than the casing set point pressure may be required to initiate movement of the shuttle from the closed position.

Figure 8:
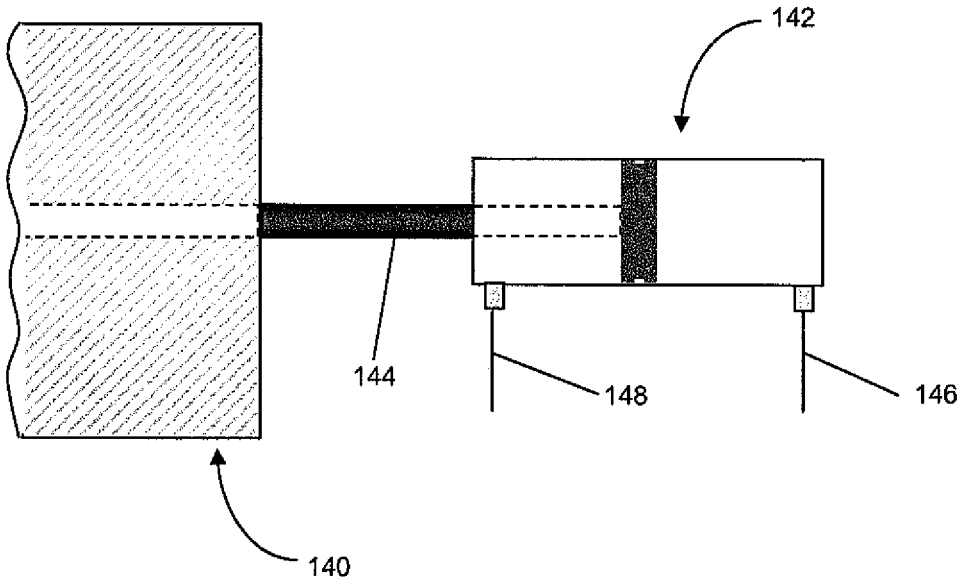
FIG. 8 is a schematic illustration of an actuated choke system useful in embodiments disclosed herein.

As illustrated in FIG. 8, for example, a choke valve 140 operated with a double-acting actuator 142 may use air or hydraulic pressure acting upon the rod 144 to both open and close the shuttle. To move the rod 144 toward the closed position, pressure may be applied to the "close" line 146 while venting the "open" line 148; to move the rod 144 toward the open position, pressure may be applied to the "open" line 148 while venting the "close" line 146.

The actuator control system responds to the measured casing pressure, and opens or closes the shuttle accordingly. However, the required overpressure, requiring a substantial buildup in either casing pressure or hydraulic "open" pressure, may slow the response of the system. Providing an amount of pressure on the "open" line 148 while the shuttle is closed may serve to reduce mechanical sticktion in the shuttle and provide faster and smoother pressure responses. For example, when the shuttle is in the closed position, the hydraulic control system may apply an amount of pressure to the "open" line 148. In this manner, the hydraulic pressure in the open line is biased toward open, allowing a faster response from the control system in maintaining pressure.

In addition, when closing the shuttle, the "open" line may be reduced to a nominal pressure. After the shuttle is closed, the hydraulic pressure in the "open" line may be increased to a pressure less than the required pressure to initiate shuttle movement from the closed position, biasing the shuttle toward the open position. Thus, when required to open the shuttle, the hydraulic system does not have to increase the hydraulic pressure in the "open" line as extensively to initiate shuttle movement. In some embodiments, the "close" line may maintain pressure when the "open" line is biased; in other embodiments, the "close" line pressure may be relaxed when the "open" line is biased.

Figure 9:
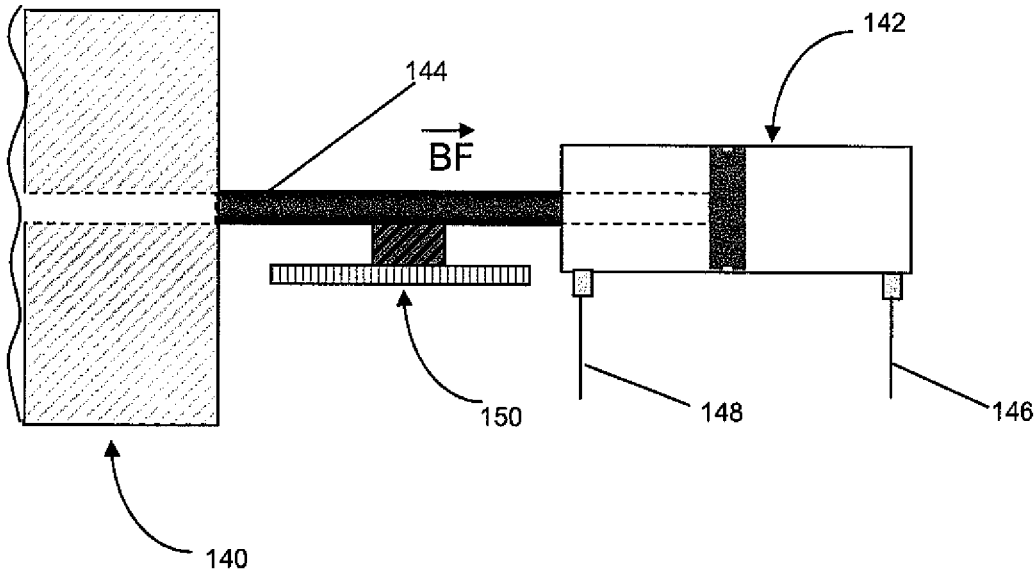
FIG. 9 is a schematic illustration of an actuated choke system incorporating a linear motor to bias a shuttle in accordance with embodiments disclosed herein.

Alternatively, as illustrated in FIG. 9, a linear motor directly or indirectly coupled to a rod 144 may be used to supply a bias force to a hydraulic actuated system. The rod 144 may open and close as described for FIG. 8, for example. A linear motor 150 may be directly or indirectly coupled to the rod 144 to apply a bias force BF to allow a faster hydraulic system response. Because the linear motor 150 may apply a bias force BF only when required, and is not used to directly control shuttle position or hydraulic force, a linear motor used in this manner may be smaller or more compact than the linear motors used in other embodiments described herein.

As described above, flat and tubular linear motors may be used to control shuttle position, and may advantageously provide for the direct correlation of electrical current (magnetic forces) and hydraulic energy. Due to the free-floating nature of linear motors, the hydraulic power generated may control the system pressure without positional restrictions (i.e., motor position does not correlate to force generated).

Figure 10A:
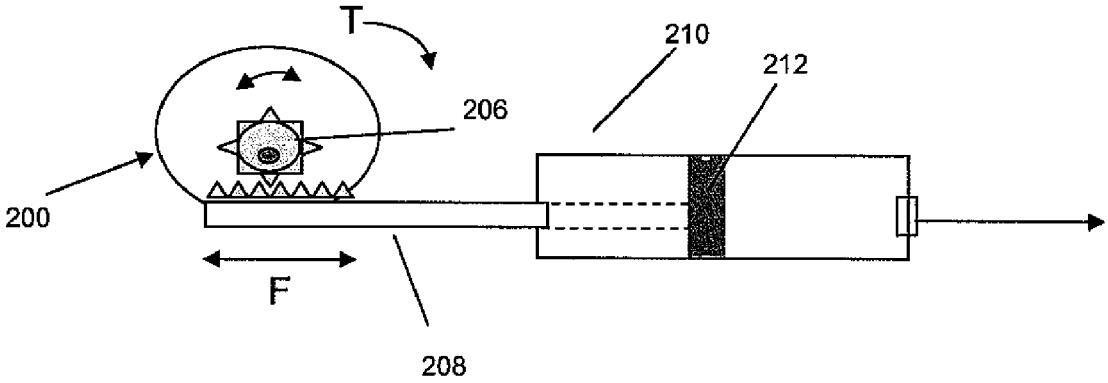
FIGS. 10*a* and 10*b* are schematic illustrations of a rotary servo motor driven hydraulic system in accordance with embodiments disclosed herein.
Figure 10B:
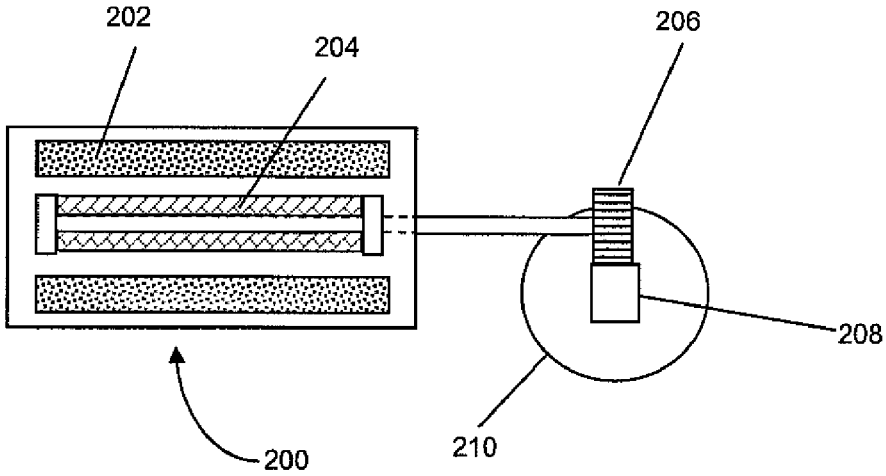

Another method that may allow for the generation of hydraulic power without positional restrictions is illustrated in FIGS. 10*a* and 10*b*. A rotary servo motor 200 having electrical windings 202 and a magnetic rotor 204, may be used to generate the hydraulic power. Magnetic rotor 204 may be coupled to gear 206 for translating the rotary motion or the rotor into hydraulic pressure, such as by controlling the position of rack and pinion toothed shaft 208 of hydraulic cylinder 210. Gear 206 may be any type of gear useful in converting rotary motion into a linear or reciprocating type motion.

Electrical current may be used to control the torque T applied to gear 206 driving shaft 208, generating a force F on the piston 212 within hydraulic cylinder 210, and generating the desired set point pressure of the control fluid, such as the control fluid flowing in and out of passage 78*a* (FIG. 2) for example. Because a constant torque may be applied with rotary servo motor 200, when the casing pressure is greater than the set point pressure, the gears may freely rotate in a direction opposite to the applied torque, allowing the shuttle to move toward an open position. As casing pressure decreases, the applied torque drives the gears, moving hydraulic fluid through passage 78*a*, and moving the shuttle toward a closed position.

In some embodiments, when the shuttle is in the fully closed position, a suction or bias force BF may be applied to the hydraulic system using rotary servo motor 200. For example, for a choke valve operating at a low pressure set point requiring an overpressure to initiate shuttle motion, rotary servo motor 200 may apply a bias torque translated into a bias force by the gears, simulating casing pressure. Thus, similar to that described for linear motors above, the overpressure required to initiate shuttle movement may be reduced. In this manner, the rotary servo motor may allow for tighter pressure control and may maintain a smoother bore hole pressure (decreasing the magnitude of the high pressure peaks, for example).

Advantageously, embodiments disclosed herein may provide for choke systems and methods for controlling pressure within tubulars. Other embodiments may advantageously provide for the direct correlation of electrical energy to hydraulic energy, allowing for improved pressure control. Other embodiments may advantageously provide for a control system for biasing the shuttle toward an open position, thereby decreasing the overpressure required to initiate shuttle movement, which may allow for tighter pressure control, especially in low-pressure systems.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

All priority documents are herein fully incorporated by reference for all jurisdictions in which such incorporation is permitted. Further, all documents cited herein, including testing procedures, are herein fully incorporated by reference for all jurisdictions in which such incorporation is permitted to the extent such disclosure is consistent with the description of the present invention.

What is claimed:

1. A fluid control system, comprising a choke assembly comprising:

a housing having an inlet passage, an axial bore, and a chamber, wherein a portion of the axial bore forms an outlet passage; and a choke member adapted for movement in the housing to control the flow of a fluid from the inlet passage to the outlet passage;

a controller to control a closing force applied to the choke member, thereby forcing the choke member toward a closed position, and to control a bias force applied to the choke member, thereby reducing an overpressure required to initiate movement of the choke member from the closed position;

a linear motor to apply the closing force and the bias force;

wherein the fluid applies a force on one end of the choke member;

wherein the bias force and the closing force are applied on an other end of the choke member, wherein the difference in applied forces controls the position of the choke member in the housing.

2. The fluid control system of claim 1, wherein the closing force is applied directly or indirectly by the linear motor.

3. The fluid control system of claim 1, wherein the bias force is supplied directly or indirectly by the linear motor.

4. The fluid control system of claim 1, wherein the closing force and the bias force are supplied directly or indirectly by the linear motor.

5. The fluid control system of claim 1, further comprising a lever coupling the linear motor to the choke assembly.

6. The fluid control system of claim 1, wherein the linear motor comprises a stationary component, a movable component, and a mass disposed on the movable component, wherein the closing and bias forces applied on the other end of the choke member comprise a weight of the mass and a force generated by the linear motor.

7. The fluid control system of claim 1, wherein the linear motor comprises a stationary component, a movable component, and a spring coupled to the movable component, wherein the closing and bias forces applied on the other end of the choke member comprise a force provided by the spring and a force generated by the linear motor.

8. The fluid control system of claim 1, the system further comprising:

a source of control fluid connected to the chamber so that the control fluid applies the closing and bias forces on the other end of the choke member to control a position of the choke member in the housing; and a linear motor to control the closing and bias forces applied by the control fluid.

9. The fluid control system of claim 8, wherein the source of control fluid comprises a hydraulic cylinder, and wherein the linear motor is directly coupled to the hydraulic cylinder.

10. The fluid control system of claim 8, wherein the source of control fluid comprises a hydraulic cylinder, and wherein the linear motor is indirectly coupled to the hydraulic cylinder.

11. The fluid control system of claim 10, further comprising a lever and a pivot, wherein the lever couples the linear motor to the hydraulic cylinder.

12. The fluid control system of claim 8, wherein the linear motor comprises a stationary component, a movable component, and a weight disposed on the movable component, wherein the weight and the linear motor contribute to the force applied by the control fluid.

13. The fluid control system of claim 8, wherein the linear motor comprises a stationary component, a movable component, and a spring coupled to the movable component, wherein the spring and the linear motor contribute to the force applied by the control fluid.

14. The fluid control system of claim 1, wherein the linear motor is a tubular linear motor.

15. The fluid control system of claim 1, wherein the linear motor is a flat linear motor.

* * * * *